United States Patent [19]

Bonetti et al.

[11] Patent Number: 4,631,839

[45] Date of Patent: Dec. 30, 1986

[54] CLOSURE DEVICE, PARTICULARLY FOR REAR OPENING SKI BOOTS

[75] Inventors: Massimo Bonetti, Padova; Giuseppe Manente, Mestre-Venezia; Abramo Mion, Mirano-Zianigo, all of Italy

[73] Assignee: E. A. Mion Ing. & Arch. Kairos S.N.C., Di M. Bonetti, G. Manente, Mirano-Zianigo, Italy

[21] Appl. No.: 717,960

[22] Filed: Mar. 29, 1985

[30] Foreign Application Priority Data

Apr. 3, 1984 [IT] Italy ..... 41548 A/84

[51] Int. Cl.[4] ..... A43B 11/00; A43B 5/04

[52] U.S. Cl. ..... 36/50; 36/117; 36/121; 24/68 SK

[58] Field of Search ..... 36/117–121, 36/105, 50; 24/68 SK, 69 SK, 70 SK, 71 SK, 71.2, 117 R, 120

[56] References Cited

U.S. PATENT DOCUMENTS

| | | | |
|---|---|---|---|
| 3,668,791 | 6/1972 | Salzman et al. | 36/50 |
| 3,729,779 | 5/1973 | Porth | 24/68 SK |
| 3,975,838 | 8/1976 | Martin | 36/121 |
| 4,408,403 | 10/1983 | Martin | 36/117 X |

FOREIGN PATENT DOCUMENTS

| | | | |
|---|---|---|---|
| 0132744 | 2/1985 | European Pat. Off. | 36/117 |
| 3013953 | 10/1981 | Fed. Rep. of Germany | 24/69 SK |
| 3342331 | 5/1985 | Fed. Rep. of Germany | 36/117 |
| 2399811 | 3/1979 | France | 36/119 |

*Primary Examiner*—James Kee Chi

*Attorney, Agent, or Firm*—Charles W. Fallow; Martin P. Hoffman; Mitchell B. Wasson

[57] ABSTRACT

The boot closure described herein includes a case housing a rotatable shaft upon which are wound straps for drawing front and rear halves of the boot upper together. The closure includes a lever connected through a pair of ratchets to the shaft, so that the straps may be tightened by moving the lever back and forth. The ratchet system may be disengaged by lifting the lever, when removal of the boots is desired.

12 Claims, 11 Drawing Figures

CLOSURE DEVICE, PARTICULARLY FOR REAR OPENING SKI BOOTS

The present invention relates to a closure device, particularly for rear opening ski boots.

BACKGROUND OF THE INVENTION

Rear opening ski boots are well known, i.e., ski boots in which the rear part of the leg portion can be opened backwards, when the skier puts his foot in the boot, and can then be pushed forwards and forced against the front part, when the ski boot has to be closed.

At present such a closure is carried out with levers and traction rings, which must be engaged with each other and require difficult manual movements, due in particular to the unfavorable environmental conditions where they have to be carried out.

Furthermore, known closure devices present the drawback of a traction incontinuity, due to the fact that if the closure is effected too slackly, to tighten it, it is necessary to release the closure device, thus losing the grip previously attained.

One object of the invention is to realize a closure device, particularly for rear opening ski boots, which allows one to carry out in an efficient, easy and quick way the opening and closure of the boot.

Another object of the invention is to realize a closure device, which does not require particular engaging and disengaging maneuvers of the traction elements at the beginning and the end of the respective closing and opening maneuvers.

A further object of the invention is to realize a closure device which allows one to regulate the grip strength without ever losing the grip previously attained.

SUMMARY OF THE INVENTION

These and other objects, which will clearly appear from the following description, are attained, according to the invention, with a closure device, particularly for rear opening ski boots comprising a case connected to a part of the upper, and a shaft rotating with respect to said case, a strap being wound upon the shaft by rotation thereof, the strap being connected to another part of the upper to be drawn forward to the first one. The strap tension is maintained by a ratchet system as a winding lever is alternatively moved in both rotative directions. In one of the two directions, the ratchet system couples the lever to the shaft, which is rotatively uncoupled from said case, and this element is would around it; in the other direction, the ratchet system uncouples the lever from the shaft, which is then rotatively coupled to said case, so that traction is maintained.

Advantageously, the case of the device according to the invention can house two face-to-face half-shells, one being rotatively coupled to the lever and uncoupled from said case, the other being bound to said case, the inner cavity formed by the two face-to-face half-shells housing a rotating element, provided with two distinct ratchet systems cooperating with the two half-shells and acting so as to couple the rotating element to the half shells for reciprocal rotation in one direction and to uncouple it for rotation in the opposite direction.

In another preferred embodiment, the case of the device according to the invention can house the shaft and a clutch plate rotatively coupled to the case and uncoupled from the shaft, a rotating element, rotatively uncoupled from said case and able to be releasably coupled to said shaft, a further element rotatively coupled to the lever and uncoupled from the case, and a ratchet system acting to couple the rotating element to the clutch plate and to the further element, when it rotates in one direction, and to keep it uncoupled, when it rotates in the opposite direction.

Advantageously, a clutch can be interposed between the winding shaft and the rotating element, said clutch being actuable from the outside to unlock the ski boot.

Preferably, the rotating element can be provided with a clutching element axially displaceable when actuated by the lever, said clutching element causing coupling between the rotating element and the shaft when the lever is on a rest or work position, and causing their uncoupling when the lever is put into an unlocking position.

BRIEF DESCRIPTION OF THE DRAWINGS

The present invention is hereinafter further clarified in three preferred embodiments with reference to the enclosed drawings, wherein.

DETAILED DESCRIPTION OF THE PREFERRED EMBODIMENT

Figure 1:
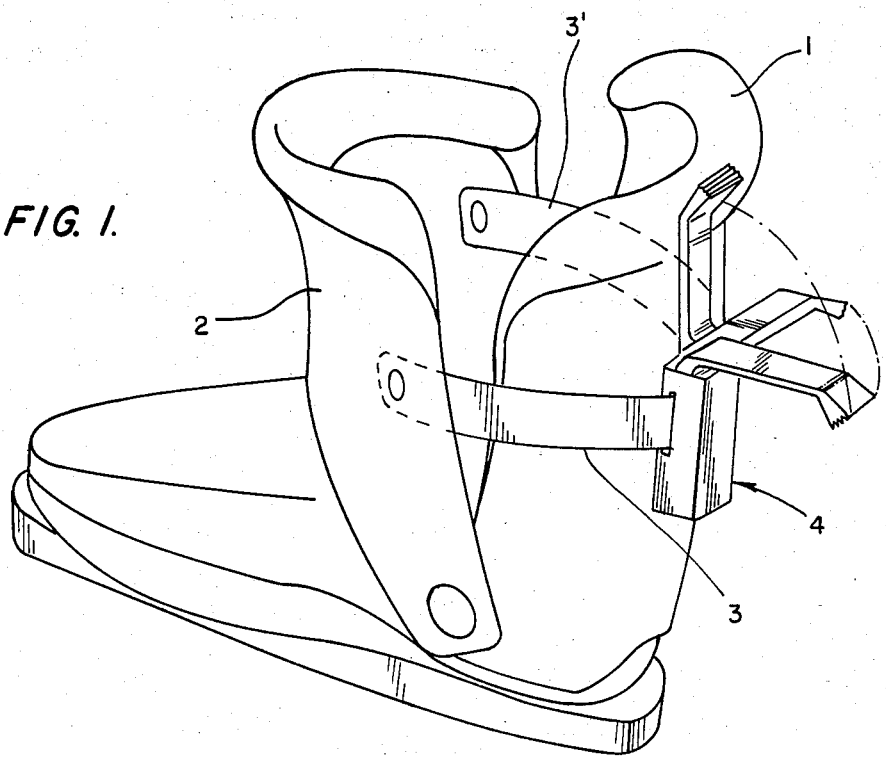
FIG. 1 is a perspective view of a closure device according to the invention in a first embodiment, applied to a rear opening ski boot and showing in several position its actuating lever.
Figure 2:
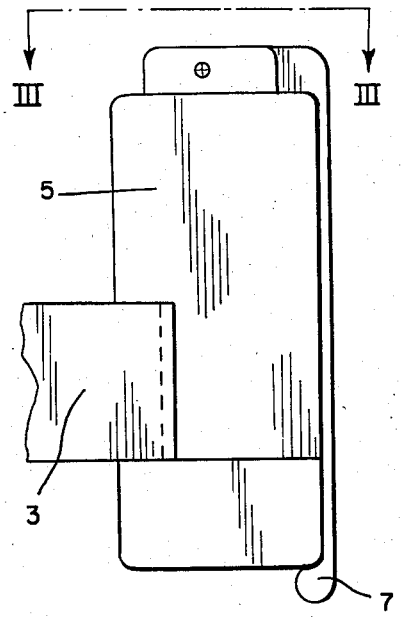
FIG. 2 is a lateral view taken along the line II—II of FIG. 3.
Figure 3:
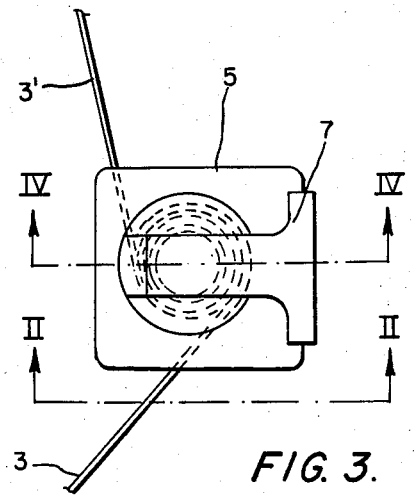
FIG. 3 is a top plan view taken along the line III—III of FIG. 2.
Figure 4:
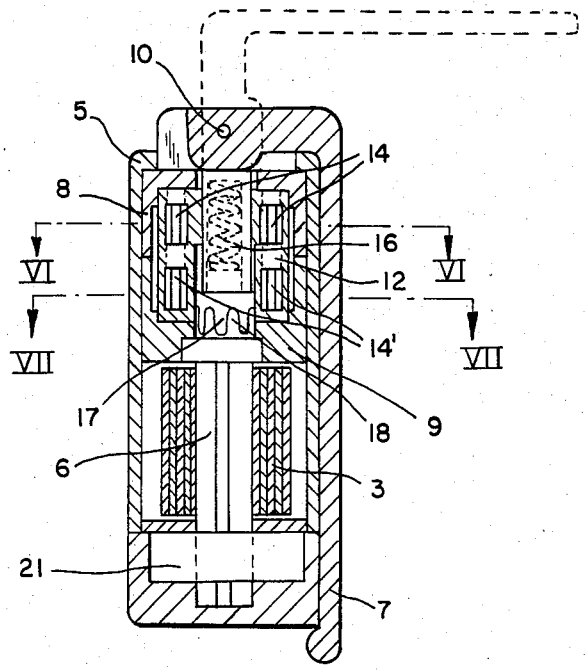
FIG. 4 is a longitudinal sectional view taken along the line IV—IV of FIG. 3.

Referring to the drawings in detail, the closure device according to the invention is interposed between the rear part 1 and the front part 2 of the leg portion of a rear opening ski boot. It comprises a pair of traction elements such as straps 3, 3' each connected at one end to the front part 2 of the leg portion and at the other end to the traction device, which is applied to the rear part 1 of the leg portion and is indicated generally by reference numeral 4.

In the embodiment shown in FIGS. 1 to 7, the traction device 4 comprises a box-like element or case 5, transversely divided (see FIGS. 4 and 5) into a lower zone, in which the winding of the straps 3, 3' around a shaft 6 occurs, and an upper zone, in which a ratchet mechanism is disposed, which, when actuated by a lever 7, causes the shaft 6 to rotate and to disengage itself from the care 5.

More particularly, inside the upper portion of the case 5 two face-to-face internally toothed half-shells 8 and 9 are placed. The upper half-shell 8 is cylindrical and can rotate with respect to the case 5. Furthermore, it pivotally supports the lever 7 by means of a horizontal pin 10. On the other hand, the lower half-shell 9 is rigidly connected to the case 5, through two ribs 11 (FIG. 7), complementary to corresponding grooves provided in the case 5.

Figure 7:
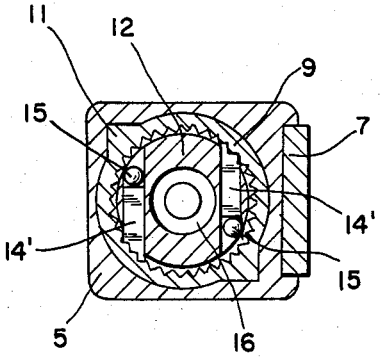
FIG. 7 is a cross sectional view taken along the lines VII—VII of FIG. 4.

In the cylindrical cavity formed by the two face-to-face half-shells, the inside diameter of which has teeth as already said, a cylindrical body 12 is housed, having therethrough an axial hole with an upper square cross section (FIG. 6) and a lower circular cross section (FIG. 7).

The cylindrical body 12 has two pairs of horizontal guideways, one pair at the level of the half-shell 8, and one pair at the level of the half-shell 9, these guideways housing counterposed ratchets 14, 14'. Each ratchet substantially consists of a small metal block slidable along the corresponding guideway and biased by a spring 15 urging its front toothed end toward the surface, correspondingly toothed, of the half-shells 8 and 9 respectively. The diametral position of the guides and of the ratchets 14, 14' is such that clockwise rotation of the cylindrical body 12 with respect to the half-shells 8 and 9 is prevented by said ratchets, while counterclockwise rotation is allowed.

As said, in the cylindrical body 12 an axial cavity is defined housing a shaft 16 which provided at its lower end with frontal toothing 17, complementary to frontal toothing 18 on the shaft 6. The upper portion of the shaft 16 has a square cross section, corresponding to the cross section of the axial cavity of the cylindrical body 12, while the lower portion has a circular cross section, corresponding to the circular section of the lower portion of said axial cavity.

The shaft 6 protrudes beyond the toothing 18 with a portion 19, in which the lower end of a helical spring 20 is engaged, housed in the axial cavity of the shaft 16 and keeping its top end resiliently adherent to the articulation head of the lever 7 to the upper half-shell 8. This articulation head is eccentrically shaped so as to cause axial movements of the shaft 16 when the position of the lever around the articulation pin 10 is varied.

The shaft 6 is also provided at its lower end with a spiralform spring 21, acting so as to cause the resilient winding of the straps 3, 3' around the same shaft 6.

The operation of the closure device according to the invention is as follows: When the ski boot is unlaced, the rear part 1 of the leg position is distant from the front part 2, the straps 3, 3' are unwound from the shaft 6, and the spiralform spring 21 is in the utmost condition of stress but it is not able to cause rotation of the shaft 6 (and thus the winding up of the straps 3, 3') because of the passive resistances of the system.

In such a configuration the lever 7 is lowered and adheres to the case 5. Thanks to the eccentricity of the head of the lever 7, the shaft 16 is kept coupled by its toothing 17 to the shaft 6, and the spring 20 is compressed and resiliently biases the lever 7 toward the case 5.

To close the ski boot, after the skier has inserted his foot therein, firstly the rear part 1 of the leg portion is drawn manually toward the front part 2, and in this phase the spring 21 causes the winding up of the straps 3, 3' around the shaft 6. It is to be noted that the counterclockwise rotation (seen from above) of the shaft 6 is transmitted to the shaft 16 and thus, through the direct rotational coupling with the cylindrical body 12, to the latter. Owing to the shape and the position of the ratchets 14, 14', the rotation of the cylindrical body 12 is not transmitted to the two half-shells 8 and 9, which therefore remain stationary.

Having reached the position of utmost manual opposition, to effectuate the grip, the skier lifts the lever 7 and moves it to the horizontal position (dashed lines in FIG. 4), without causing any axial displacement of the shaft 16, thanks to the shape of the lever 7.

After the lever 7 has reached the horizontal position, which is stably maintained by the spring 20, the skier gives it a series of clockwise and counterclockwise rotations: in the phase of counterclockwise rotation the movement is transmitted to the upper half-shell 8 and, by means of the upper ratchet 14, working during this phase, to the cylindrical body 12.

Through the direct rotational coupling between the cylindrical body 12 and the shaft 16, the clockwise rotation is transmitted to the latter, which in this mode of rotation is uncoupled from the lower half-shell 9, which is integral to the case 5. The counterclockwise rotation of the shaft 16 is transmitted, through the coupling 17 and 18, to the shaft 5 and causes the partial forced winding of the straps 3, 3' around it.

In the following phase of clockwise rotation, such a movement is transmitted to the upper half-shell 8 but not to the cylindrical body 12, because of the inactivity of the ratchets 14. On the other hand, in this phase the elastic reaction of the system does not permit any loosening of the straps 3, 3', inasmuch as the rotation of the shaft 6, and so that of the shaft 16, is opposed by the ratchets 14', which couple that body 12 to the fixed lower half-shell 9.

On reaching the desired strap tension, the lever 7 is put back in its initial lowered position and the ski boot is ready for use.

Figure 5:
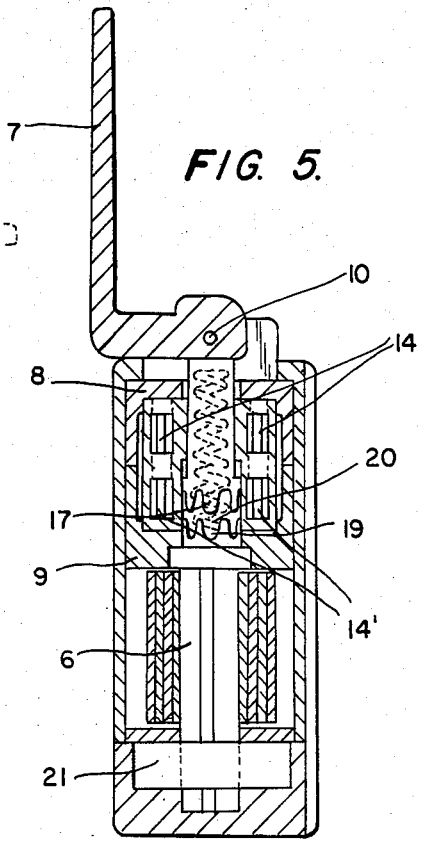
FIG. 5 is a view similar to that of FIG. 4 but with the actuating lever turned 180° upwards.
Figure 6:
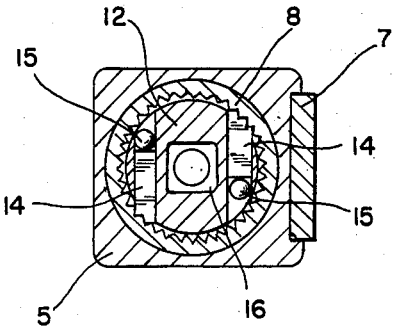
FIG. 6 is a cross sectional view taken along the line VI—VI of FIG. 4.

When it is required to reopen the ski boot, the lever 7 is turned 180° around the pin 10 (FIG. 5). The particular eccentricity of the head of the lever 7 and the V-shape of the teeth 17, 18 make easier the decoupling of the shaft 16 from the shaft 6 by the spring 20, and furthermore cause such a decoupling also in the case of accidental breakage of said spring. When the shaft 6 is not bound to the case 5, rapid unwinding of the straps 3, 3' and displacement of the rear part 1 from the front part 2 of the leg portion take place.

The device according to the invention requires, to lock the boot, a succession of oscillations of the lever 7 alternately in clockwise and counterclockwise directions. In one direction (in the counterclockwise direction in the illustrated embodiment), partial rotation of the shaft 6 is caused with respect to the case 5 and therefore winding of the straps 3, 3' occurs; in the other direction, the lever 7 is put back in its original position, while keeping the shaft 6 locked with respect to the case 5.

To open the boot, the shaft 6 is disengaged from the case 5, so that the resilient reaction of the system, no longer restrained, causes the rapid unwinding of the straps 3, 3' from the shaft 6 without using the lever 7.

From what has been said the closure device according to the invention allows one to obtain many advantages, and in particular: it allows one to open and close a ski boot in a very easy, quick and efficient manner, through a simple movement of a lever; it allows one to carry out such movements without having to engage and to disengage the various components, which are always engaged with each other; it allows one to carry out the locking of the ski boot substantially without any limit in the intensity of the grip and never losing, after each phase of tightening, the grip previously attained.

Figure 8:
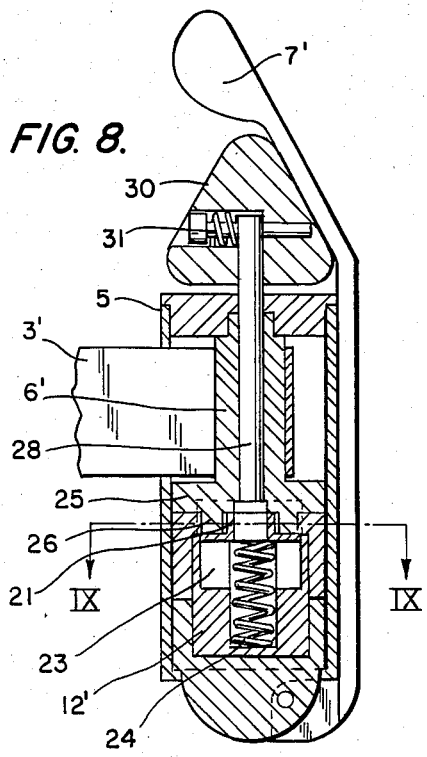
FIG. 8 is a longitudinal sectional view of a second embodiment.
Figure 9:
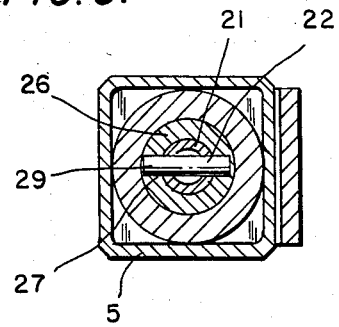
FIG. 9 is a cross sectional view taken along the lines IX—IX of FIG. 8.

In the embodiment illustrated in FIGS. 8 and 9, while retaining the same general principle of the closure through the oscillatory movement of the lever 7', the system of coupling and uncoupling between shaft 6' and cylindrical body 12' is different. In particular the cylindrical body 12', (which in this embodiment occupies the lower part of the case 5 and for simplicity reasons has been represented without ratchets 14, 14') is provided, on the side facing the shaft 6', with a cylindrical protrusion 21, having, as well as a part of said body 12', a diametral groove 22 with a depth remarkably superior to its width. On the bottom of said groove 22 a hole 23 is defined, housing a helical spring 24.

The shaft 6', which is axially hollow, in its turn is provided with a cylindrical portion 25 facing the cylindrical body 12' and having an annular protrusion 26, which houses on its inside the cylindrical protrusion 21 of the body 12'. Also this annular protrusion 26 has a diametral groove 27 with walls diverging towards the outside; the height of this annular protrusion 26 and also of its diametrical groove 27 is substantially equal to the height of the cylindrical protrusion 21, while its minimum width is substantially equal to the width of the diametrical groove 22.

On the inside of the shaft 6' a rod 28 is housed, axially slidable and provided at its internal end with a cylindrical transverse pin 29, having a length substantially equal to the external diameter of the annular protrusion 26 and a diameter substantially equal to the width of the diametrical groove 22.

At the other end of the rod 28, which protrudes from the top said of the case 5, a plate 30 is pivotally connected, movable between a horizontal position, in which the pin 29 is in its inferior limit and is wholly housed on inside of the groove 22, below the protrusions 21 and 26, and a vertical position, in which the pin 29, also forced by the spring 24, is in its superior limit and is simultaneously housed in the grooves 22 and 27 of the two protrusions 21 and 26 respectively, thus coupling them together.

A small spring 31, interposed between rod 28 and plate 30, tends to keep the latter, in the absence of other external forces, in the vertical position, which is stable, since its lower edge lies on the top surface of the case 5.

Also in this case a spiralform spring can be provided, similar as to shape and function to the spiralform spring 21 of the previous embodiment; this spring has not been illustrated in the drawings for representative simplicity.

In operation of the second embodiment described above, the closure maneuver is carried out, as in the previous case, by moving the lever 7' back and forth in both rotative directions. In this phase, as already said, the vertical position of the plate 30 keeps the pin 29 stably in its upper limit position, coupling the cylindrical body 12' to the shaft 6' so that the movements of said body 12', due to the lever 7', are transmitted to the shaft 6' and cause the winding thereon of the straps 3, 3'.

To carry out the quick unlocking of the ski boot, it is sufficient to turn the plate 30 90° and put it in a horizontal position, In this way the stresses of the system and the V-shape of the walls of the grooves 27 cause a downward slip of the pin 29, which can eventually be helped in its descent by pressure on the little plate 30 applied by the skier. As soon as the pin 29 is out of the groove 27, the shaft 6' is uncoupled from the cylindrical body 12' and the quick unwinding of the straps 3, 3' from this is allowed. Obviously, at the end of this unlocking phase, the spring 24 tends resiliently to push the pin 29 towards its upper limit position. If the two grooves 22 and 27 are aligned with each other, the pin 29 engages them directly, lifts itself and allows the small spring 31 to cause the plate 39 to rotate to its vertical position, thus preparing the system for a subsequent closure. If the two grooves 22 and 37 are not aligned, the coupling between the cylindrical body 12' and the shaft 6' will occur automatically at the beginning of the next closure.

Figure 10:
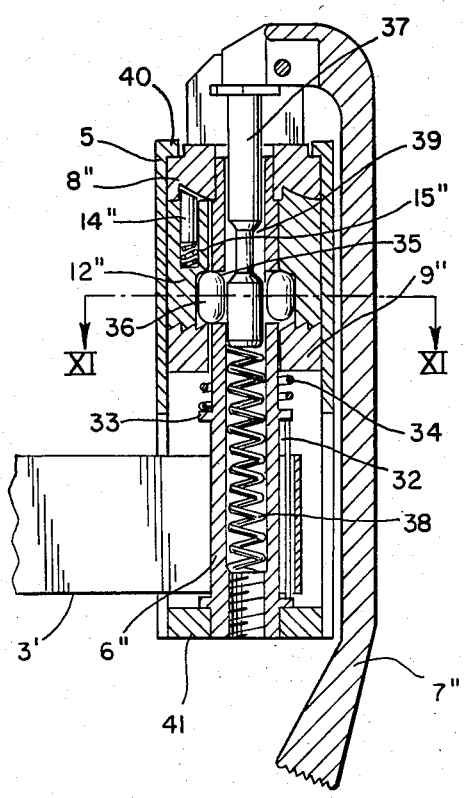
FIG. 10 is a longitudinal sectional view of a third embodiment.
Figure 11:
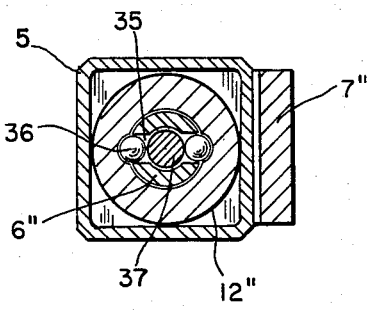
FIG. 11 is a cross sectional view taken along the lines XI—XI of FIG. 10.

In FIGS. 10 and 11, a third embodiment of the device according to the invention is shown. It is quite similar to the embodiment of FIGS. 1 to 7, but it is of easier manufacture and more reliable operation.

In particular, the case 5 houses a shaft 6'', provided on the lower portion with a slot 32, in which the two straps 3, 3' to be wound are engaged. In the upper part of the case 5 a ratchet system is housed, essentially comprising a plate 9'', rotationally bound to the case 5 but axially slidable along the shaft 6'', a cylindrical body 12'' and a toothed element 8'', to which the eccentric upper head of a lever 7'' is pivotally connected.

The plate 9'' is of square shape, corresponding to the inner cross section of the case 5 and in its upper face an annular saw toothing is provided.

Between the plate 9'' and an underlying circumferential rib 33, which is provided on the shaft 6'', a helical spring 34, resiliently compressible, is placed. The cylindrical body 12'' is provided with a lower annular saw toothed portion, which can be coupled to that of the plate 9'', and it is also provided on the opposite top surface with a plurality of vertical ratchets 14'', housed in corresponding holes and kept resiliently protruding upwards by small helical springs 15''.

In the axial hole containing the shaft 6'', two small axial grooves 35 are provided in the cylindrical body 12'', each of which partially houses a ball 36. The protruding position (from the shaft 6'') of the ball 36 is determined by an element 37, which is axially slidable within the shaft 6'' against the resilient reaction of a spring 38.

The element 37 is provided with a narrowed portion 39, which, in absence of other external forces, is above the balls 36, but can be placed at the same level, when the element 37 is pushed downwards.

The element 8'' is saw toothed on its lower surface and therefore it can be engaged by the ratchets 14''. The lever 7'' is pivotally connected to the element 8'' and bears with its eccentrical head on the head of the element 37.

On the element 8'', a lower flange is provided, bearing on a plate 40, which closes, together with a lower removable plate 41, the case 5.

Also in this embodiment, as in the preceding ones, a spring may be applied to the shaft 6'', which causes the straps 3, 3' to be would around it, and which has not be illustrated in the drawings for representative simplicity.

The operation of the closure device according to this third embodiment substantially parallels the operation of the device according to the first embodiment. In particular, the closure maneuver is carried out, after the lever 7'' has been turned to its horizontal position, the element 37 being kept in such a position that the balls 36 are allowed to protrude partially from the shaft 6'' and to engage the corresponding grooves 35, thus connecting the cylindrical body 12'' to said shaft 6''. The lever 7'' is then reciprocally actuated in both rotative directions in the horizontal plane.

When the lever 7'' rotates clockwise (seen from above), such rotation is transmitted to the element 8''; hence, through the ratchets 14'', to the cylindrical body 12'', and hence, through the balls 36, to the shaft 6'', which causes the straps 3, 3' to wind around it.

In this phase, the clockwise rotations of the lever 7'', the cylindrical body 12'' is rotatively standing with respect to the case 5 and at the same time it is coupled to the shaft 6'', during any counterclockwise rotation the straps 3, 3' are kept in the taut condition attained in the previous clockwise rotation.

After having reached the desired locking of the ski boot through several of clockwise and counterclockwise rotations, the lever 7'' is put in the rest position (vertically lowered). This maneuver has no effect on the element 37, thanks to the shape of the eccentrical articulation head of the lever 7'' to the element 8''.

To carry out the quick unlocking of the ski boot, the lever 7'' is turned 180 upwards. Because of the eccentricity of the articulation head of the lever 7'', this rotation causes the axial downward displacement of the element 37, so that the narrowed portion 39 faces the balls 36. These are pushed away from the grooves 35 of the cylindrical body 12'', and the shaft 6'' is disengaged from the cylindrical body 12'', allowing the unwinding of the straps 3, 3'.

We claim:

1. A closure device, particularly for a rear opening ski boot comprising a case for connection to one part of the boot, a shaft rotatably supported by said case, at least one traction element wound upon said shaft, a lever pivotally mounted for winding said shaft, and ratcheting means for converting oscillatory movement of said lever to unidirectional tensioning of said traction element, said means comprising a first ratchet adapted to couple said lever to said shaft when said lever is moved in a first angular direction while allowing free movement of the lever in a second direction opposite the first, and a second ratchet adapted to couple said shaft to said case to prevent reverse angular movement of said shaft when said lever is moved in said second direction while allowing forward angular movement of said shaft as the lever is moved in said first direction.

2. A device according to claim 1, further comprising means for snap disengaging said shaft from said case.

3. A device according to claim 1, wherein the boot has an upper portion comprising a rear part to which said case is connected, and a front part to which two of said traction elements are connected, extending along both sides of the boot.

4. A device according to claim 1 further comprising a rotatable body and wherein:

said first ratchet comprises a first half-shell having internal teeth and at least one pawl normally in engagement with said teeth, said pawl being carried by said body, and said first half-shell being rotatably coupled to said lever, and wherein:

said second ratchet comprises a second half-shell axially aligned with the first half-shell, said second half-shell also having internal teeth, and at least one pawl, also carried by said body and normally in engagement with the teeth of said second half-shell, the latter being coupled to said case, thereby to prevent rotation of said second half-shell.

5. A device according to claim 4 further comprising means for biasing each of said pawls toward its respective half-shell, thereby causing said normal engagement.

6. A device according to claim 4 wherein said shaft is normally rotatably coupled to said second half-shell and further comprising a clutch for permitting one to disconnect said shaft from said second half-shell in order to loosen said traction elements.

7. A device according to claim 6 further comprising means for disengaging said clutch said means being operable by pivoting said lever about an axis normal to said shaft.

8. A device according to claim 7 wherein said disengaging means comprises a rod axially displaced by pivoting said lever about said normal axis.

9. A device according to claim 8 wherein said clutch comprises a pair of coaxial members having corresponding slots therein, and at least one radially movable ball adapted, when in one extreme radial position, to couple said members by engaging said corresponding slots, said rod having camming means normally driving said ball to said one extreme position, while allowing said ball to withdraw when said rod is axially displaced.

10. A device according to claim 6 further comprising a torsion spring biasing said shaft in said forward direction, so as to withdraw slack from said traction elements prior to operating said lever.

11. A device according to claim 6 further comprising an actuating rod axially slidable between activating and deactivating positions of the clutch and further comprising means for keeping the rod, in absence of other external forces, in the activated position.

12. A device according to claim 11 wherein the clutch comprises a pair of coupled concentric portions integral with the rotating element and with the shaft and having a diametral groove simultaneously engageable by a pin mounted on the rod.

* * * * *